United States Patent [19]

Inbar

[11] 4,151,853

[45] May 1, 1979

[54] CRUTCH CONSTRUCTION

[76] Inventor: Amnon Inbar, 120 N. View Ave., Cranston, R.I. 02920

[21] Appl. No.: 850,703

[22] Filed: Nov. 10, 1977

[51] Int. Cl.[2] ..... A61H 3/02

[52] U.S. Cl. ..... 135/71; 135/69; 135/72; 403/90; 403/104; 403/374

[58] Field of Search ..... 135/68, 69, 71, 72; D88/4, 5; 403/90, 104, 374

[56] References Cited

U.S. PATENT DOCUMENTS

| | | | |
|---|---|---|---|
| D. 213,537 | 3/1969 | Parry | D88/5 |
| 768,452 | 8/1904 | Hennessey | 135/69 X |
| 2,388,778 | 11/1945 | Wheeler | 135/68 |
| 2,409,365 | 10/1946 | Lamb | 135/71 |
| 2,670,748 | 3/1954 | Greene et al. | 135/69 |
| 3,635,233 | 1/1972 | Robertson | 135/71 |
| 3,757,807 | 9/1973 | Manzo | 135/68 X |

*Primary Examiner*—Price C. Faw, Jr.
*Assistant Examiner*—Conrad L. Berman
*Attorney, Agent, or Firm*—Salter & Michaelson

[57] ABSTRACT

A crutch construction of the "Canadian" type that includes an elongated lower support assembly on the uppermost end of which a universally adjustable hand rest is interconnected. An upper forearm support assembly is provided with a forearm cuff member, the vertical axis of which is generally aligned with the vertical axes of the hand rest and the lower support assembly, wherein the forces exerted by the weight of the user on the crutch are transmitted directly through the aligned lower support assembly and hand rest for distribution to the hand of the user as located on the hand rest and through the forearm of the user as positioned in said cuff member.

16 Claims, 6 Drawing Figures

CRUTCH CONSTRUCTION

BACKGROUND OF THE INVENTION

The present invention relates to a crutch construction, and more particularly relates to a crutch of the "Canadian" type that provides for forearm support as opposed to the underarm support type.

The so-called "Canadian" crutch has been developed to avoid the problems that have been experienced heretofore with the underarm support type of crutch. The "Canadian" crutch includes a vertical member to which a forwardly extending bar-type hand rest is secured. The forearm cuff is interconnected to the vertical member and bar-type hand rest and engages the forearm of the user, so that loads as exerted by the user through use of the crutch are transferred through the hands and forearms of the user, as opposed to the transfer of loads to the underarm of the user in the conventional underarm support type of crutch. Although the "Canadian" type of crutch has avoided the heretofore known problems experienced in underarm support crutches, by somewhat alleviating the round shouldered effect experienced in the underarm support crutch, the "Canadian" crutch as used heretofore still does not provide an ideal appliance for the user, since the weight distribution through the hand rest and upper vertical member to the forearm is such as to cause the user to slump forwardly. Further, the "Canadian" crutch utilizes a bar-type of hand rest that is uncomfortable to the user and easily produces fatigue after only a relatively short period of use. In practice the conventional "Canadian" crutch is not easily adjusted to the user's physical or anatomical requirements, and oftentimes, the user is not able to use the crutch for any period of time without becoming fatigued or disabled.

Prior known crutches as represented by the prior issued U.S. patents are best illustrated in the patents to Wheeler No. 2,388,778, Neptune No. 2,568,654, Wood No. 2,736,330, Murcott No. 3,157,187, Gilsdorf No. 3,517,678 and Manzo No. 3,757,807.

SUMMARY OF THE INVENTION

The present invention relates to a crutch construction of the "Canadian" type and provides for alignment of the hand rest with the forearm cuff and lower vertical support assembly to distribute the weight of the user in a manner that enables the user to most efficiently utilize the crutch.

The crutch construction of the present invention comprises an elongated lower support assembly to which a hand rest is interconnected in vertical alignment therewith. An upper forearm support assembly that includes an upper support member is located in offset relation with respect to the vertical axis of the hand rest, a forearm cuff member being joined to the upper support member and also being aligned with the vertical axes of the hand rest and lower support assembly. By aligning the axes of the lower support assembly hand rest and forearm cuff member, the forces exerted by the weight of the user on the crutch are transmitted directly through the aligned lower support assembly hand rest for distribution to the hand of the user as located on the hand rest and through the forearm of the user as positioned in the cuff member.

Accordingly, it is an object of the present invention to provide a crutch construction that efficiently distributes the weight of the user through his hand and forearm as a result of the placement and location of the hand rest and cuff member relative to the lower support assembly.

Another object of the invention is to provide a unique adjustable hand rest for a crutch construction that enables the user thereof to effectively transfer the loads exerted by his weight through the palms of his hands to his forearms and shoulders.

Another object is to provide a crutch construction that includes a vertically aligned hand rest, forearm support and lower support assembly, wherein only vertical components of force are transmitted therethrough and horizontal and angularly disposed components of force are avoided.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
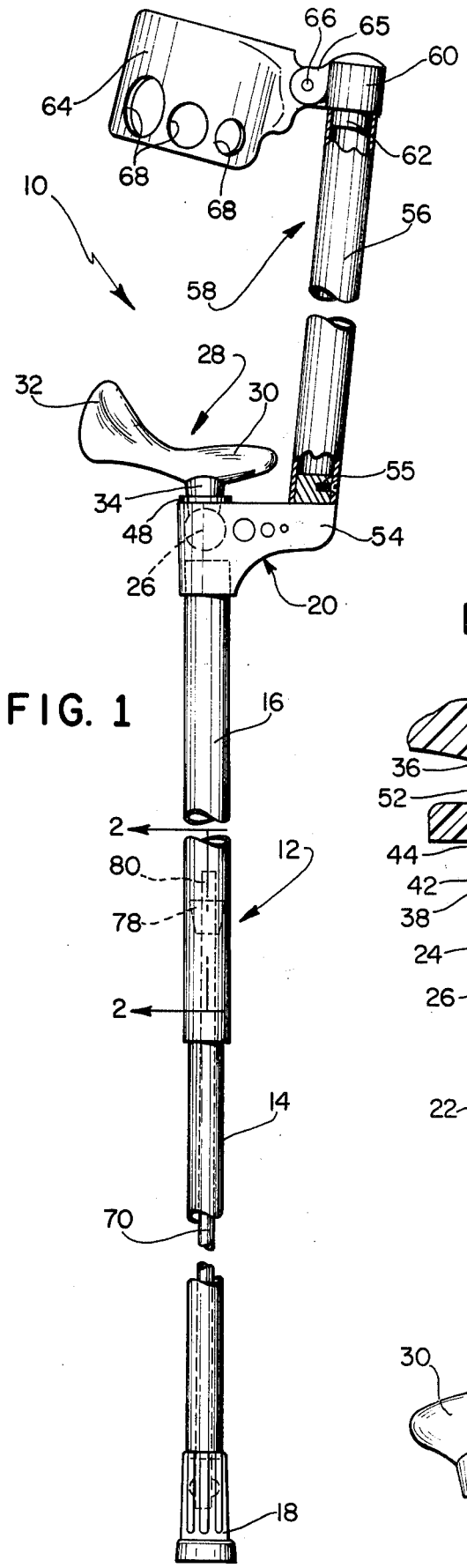
FIG. 1 is an elevational view, with parts shown in section of the crutch construction embodied in the present invention.

Referring now to the drawing and particularly to FIG. 1, the crutch construction embodied in the present invention is illustrated and is generally indicated at 10. Forming the lower end of the crutch construction and defining the support thereof is an elongated lower support assembly generally indicated at 12. The lower support assembly 12 is defined by a lower tubular member 14 and an upper tubular member 16 mounted on the lower tubular member 14 in telescoping relation with respect thereto. A pad 18 having a socket formed therein is located at the lowermost end of the lower tubular member 14 and is formed of a flexible material in the usual manner to provide a friction element for engaging the ground during use of the crutch construction. The lowermost end of the lower tubular member 14 is received in the socket of the pad; and as will be described hereinafter, the pad 18 is rotated relative to the lower tubular member 14 to unlock the lower tubular member 14 for engagement with the upper tubular member 16 when a vertical adjustment of the crutch 10 in accordance with the physical requirements of the user is necessary.

Figure 4:
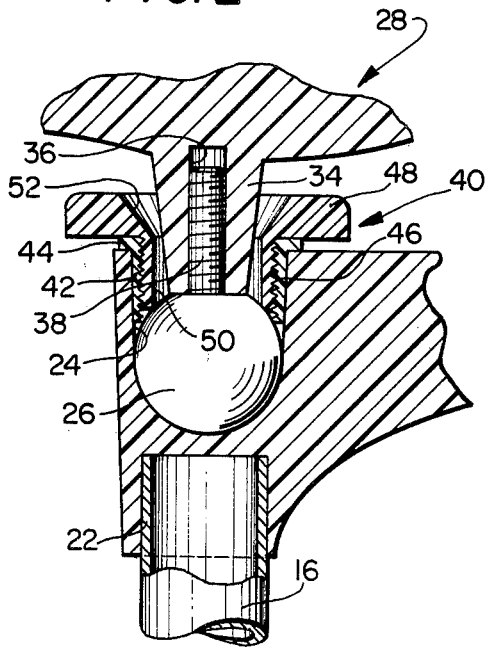
FIG. 4 is a sectional view showing the universal joint of the hand rest as formed in the intermediate support member of the crutch construction.

Secured to the uppermost end of the upper tubular member 16 of the lower support assembly 12 is an intermediate support member generally indicated at 20. The intermediate support member 20 is molded of a relatively rigid thermosetting plastic material that is capable of carrying the user's weight during the use of the crutch construction. As shown more clearly in FIG. 4, the intermediate support member is formed with a lower cavity 22 that is dimensioned for receiving the uppermost end of the upper tubular member 16, the cavity 22 being of sufficient vertical dimension to frictionally receive the uppermost end of the upper tubular member 16 in tightfitting relation therein. Formed in the upper most end of the intermediate support member 20 and located in aligned co-axial relation with respect to the cavity 22 is a socket 24. As shown in FIG. 4, the lowermost end of the socket 24 has a concave configuration for accommodating a ball 26 that is secured to a hand rest generally indicated at 28 that will be described hereinafter.

Figure 5:
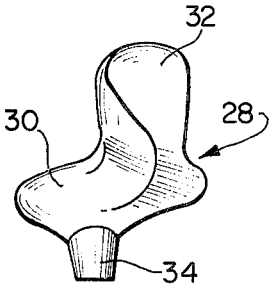
FIG. 5 is a front elevational view of the hand rest.
Figure 6:
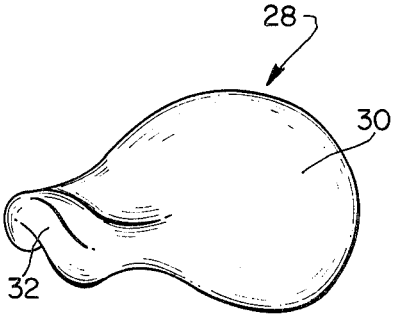
FIG. 6 is a perspective view of the hand rest.

Referring now to FIGS. 1, 5 and 6, the hand rest 28 as illustrated has a configuration that is designed to be engaged substantially by the peripheral portions of the palm of the user's hand that substantially prevents the loads being exerted on the user's palm and also avoids the requirement of the user curling his fingers around the hand rest in gripping relation as normally experienced in the bar-type grip. For this purpose the hand rest 28 includes a body portion 30 for receiving the palm of the user thereover, the vertical axis of the body portion 30 being substantially in alignment with the ball 26 and the lower vertical support assembly 12. The body portion 30 is generally convex in configuration and as illustrated in FIG. 1 the widest part thereof overlies the vertical axis of the lower tubular member 12, the peripheral areas of the body portion 30 receiving the heel pads (thenar areas) of the user's palm thereover in supporting relation. The body portion 30 of the hand rest 28 tapers forwardly and upwardly into a horn portion 32 which is offset with respect to the vertical axis of the body portion 30 and which in use of the device is received between the thumb and forefinger of the user. In this position the methacarpal phelangeal pads at the base of the fingers and the heel pads (thenar areas) of the user engage the adjacent portions of the body portion 30 and substantially carry the load as exerted by the weight of the user. This distribution of the weight or forces along the pads at the base of the fingers and the heels of the hand in contrary to the use of the conventional crutch, wherein the weight of the user is carried through the palm of the hand.

Extending below the body portion 30 and in alignment with the axis of the lower support assembly 12 is a tapered projection 34 in which a threaded bore 36 is formed. As is more clearly illustrated in FIG. 4, the ball 26 that is formed as part of the hand rest 28 is also formed of a rigid plastic material and has a threaded stem 28 joined thereto, the threaded stem 38 being threadably received within the bore 36 for securing the ball 26 to the lowermost end of the projection 34. As illustrated in FIG. 4, the ball 26 is received in the socket 24 and cooperates therewith to define a universal joint for locating the hand rest 28 in a position that is most comfortable for the user of the crutch construction 10. Thus, the user can move the hand rest 28 in any desired direction for locating the hand rest in that position that is most suitable to his physical and anatomical requirements, in which position the hand rest 28 locates the palm of the user directly over and in alignment with the vertical axis of the lower support assembly.

In order to secure the ball 26 within the socket 24 for locating the hand rest 28 in the desired position, a lock member generally indicated at 40 is provided. As further illustrated in FIG. 4, the lock member 40 includes an interior bushing 42 formed with an outer flange 44 and is frictionally secured within the socket 24. The interior wall of the bushing 42 is threaded for receiving a threaded shank 46 of a lock nut 48. Formed in the shank 46 of the lock nut 48 is a central opening 50 that communicates with a countersunk opening 52 that is formed in an enlarged head of the lock nut 48. The opening 50 in the shank 46 and the countersunk opening 52 accommodate the tapered projection 34 of the hand rest therein and provide for universal movement of the hand rest as it is moved in an adjusting motion, the ball 26 rotating within the socket 24 in accordance with the adjustable movement of the user. In order to secure the hand rest 28 in the adjusted position, the lock nut 48 is rotated to move it inwardly into locking engagement with the ball 26, the lowermost edge of the shank 46 engaging the adjacent surface of the ball and forcing the ball 26 into a locked position in the socket 24. When it is necessary to adjust the hand rest to the user's requirements, the lock nut 48 is rotated relative to the bushing 42 to retract the shank 46 from engagement with the ball 26. The hand rest is then adjustably moved in a universal motion to the position required. Thereafter, the lock nut 48 is screwed downwardly relative to the bushing 42 into engagement with the ball 26 to again lock the hand rest 28 in a fixed adjusted position.

Formed as part of the intermediate member 20 on the rearmost end thereof and projecting upwardly therefrom is an extension 54. The axis of the extension 54 is slightly inclined to the vertical as will be described, and mounted on the extension 54 is an elongated tubular section 56 that is formed as part of an upper support assembly generally indicated at 58. As shown in FIG. 1, a set screw 55 extends through an opening formed in the tubular section 56 at the lower end thereof and engages the extension 54 for securing the tubular section 56 to the intermediate support member 20.

Mounted on the uppermost end of the tubular section 56 of the upper support member 58 is a cap member 60 to the lowermost end of which a projection 62 is integrally joined, the projection 62 extending into the uppermost end of the tubular section 56. Pivotally connected to the cap member 60 is a forearm cuff 64 that has a substantially U-shaped configuration as utilized in the conventional "Canadian" type crutch. Joined to the cap member 60 are spaced ears 65 between which a lug that is integrally joined to the cuff 64 projects. A pivot pin 66 extends through the lug and ears 65 and pivotally interconnects the cuff 62 to the cap member 60, the cuff 64 being pivotally moved relative the cap member 60 so as to be accommodated on the forearm of the user in the required position of use. As illustrated in FIG. 1, the axis of the cuff 64 is slightly inclined with respect to the vertical, although in actual use thereof, the axis of the cuff 64 will normally be aligned and in co-axial position relative to the axis of the hand rest 28 and the lower support assembly 12. As also shown in FIG. 1, the cuff 64 is formed with a plurality of openings 68 that provide for air circulation within the cuff when it is mounted on the forearm of the user.

As is described above, the axis of the tubular section 56 is inclined to the vertical and with respect to the axis of the lower support assembly 12. The angle as defined by the axes of the tubular section 56 and the lower support assembly 12 is approximately five degrees, which is considerably less than the angle that is formed between the corresponding cuff support member and vertical support of the conventional "Canadian" crutch construction. By reducing the angular relationship between the tubular section 56 and the lower support assembly 12, the user of the crutch is able to locate his shoulder, forearm and hand generally in vertical alignment with the vertical support member 12 that carries a load during use of the crutch. Thus, the forces exerted by the weight of the user are substantially in a vertical direction, and the horizontal and other components of force are substantially eliminated.

Figure 2:
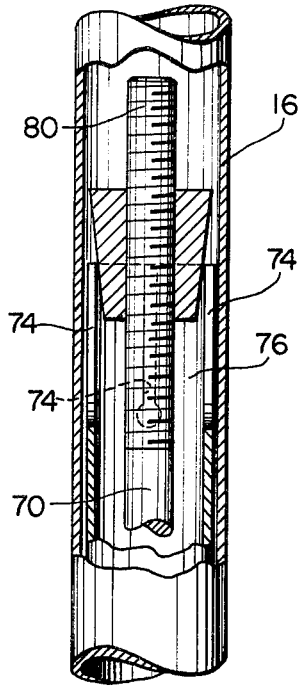
FIG. 2 is a sectional view taken along line 2—2 in FIG. 1 showing the released position of the locking wedge during a vertical adjustment of the telescoping elements of the lower support assembly.
Figure 3:
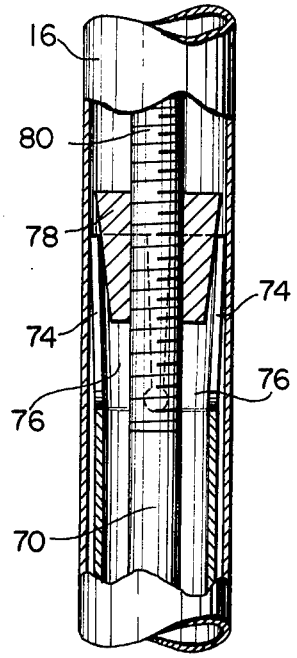
FIG. 3 is a view similar to FIG. 2 showing the locked position of the locking wedge after the telescoping element of the lower support assembly have been vertically adjusted.

Since the crutch construction 10 is adapted for use by individuals of different heights and physical constructions, it is desirable to adjust the height of the lower support assembly 12. For this purpose, the lower tubular member 14 is telescopically moved relative to the upper tubular member 16. In order to provide for the locking of the lower tubular member 12 relative to the upper tubular member 16 in the adjusted position, a lock assembly is provided and includes an adjustment rod 70, the lowermost end of which is secured in the pad 18. Thus rotation of the pad relative to the lower tubular member 14 will also rotate the adjustment rod therewith. Referring now to FIGS. 2 and 3, the uppermost end of the lower tubular member 14 is shown being formed with spaced, vertically extending slots 74 therein, the slots 74 defining a plurality of spring fingers 76 therebetween. The spring fingers 76 are movable from the position illustrated in FIG. 2 to the position shown in FIG. 3, wherein they are located in contact with the inner surface of the adjacent tubular member 16 thereby securing the lower tubular member 14 to the upper tubular member 16. In order to urge the spring fingers 76 into engagement with the inner surface of the upper tubular member 16, as shown in FIG. 3, a locking wedge 78 is provided and is formed with an internally threaded bore that threadably receives a threaded portion 80 located on the upper end of the adjustment rod 70. The lower tubular member 14 is fixed in position with respect to the upper tubular member 16 by rotating the pad 18 in the appropriate direction which, in turn, rotates the adjusting rod 70 therewith. As the adjusting rod 70 is rotated, the threaded portion 80 causes the wedge 78 to move from the position shown in FIG. 2 to the position illustrated in FIG. 3, wherein the wedge 78 is retracted interiorly of the lower tubular member 14 thereby forcing the spring members 76 outwardly into engagement with the inner surface of the upper tubular member 16. Whenever it is necessary to adjust the vertical position of the hand rest 28 or the cuff 64, the adjusting rod 70 is rotated in the opposite direction to that just described to release the locking wedge 78, wherein the lower tubular member 14 is then moved relative to the upper tubular member 16 to the desired adjusted position. Thereafter, the adjusting rod 70 is again rotated by the pad 18 to effect the clamping of the spring member 76 into engagement with the inner surface of the upper tubular member 16.

It is seen that the crutch construction 10 as embodied in the present invention provides an orthopedic appliance that is particularly adapted for use by those individuals who have need of a crutch for indefinite or long periods of time. Location of the forearm cuff 64, hand rest 28 and lower support assembly 12 insures that the forces exerted by the weight of the user are substantially vertical and are absorbed by the hand and forearm and shoulder of the user. This is contrary to the heretofore type known "Canadian" crutch wherein the vertical axis of the cuff was offset with respect to the vertical axis of the lower support. This produced various components of force that were not distributed in a manner that were easily absorbed by the user and produced a round shouldered or slumping effect that caused early fatigue in use of the crutch.

The present invention also provides for a unique hand rest that is movable in a universal motion to properly position the hand rest such that the hand of the user is in a position to absorb and transfer the vertical forces exerted by the weight of the user to his forearm and shoulder. Further, the hand rest is designed to enable the user to have his fingers free during the use of the crutch, for carrying articles. The configuration of the hand rest also enables the user to change his hand position on the rest to alleviate fatigue as opposed to the conventional cylindrical handle construction that can only be held in a single grab position.

If necessary, the upper support assembly 58 can be removed from the intermediate support member 20 by loosening the set screw 55 and lifting the tubular section 56 from the extension 54. With the upper support assembly 58 removed, the lower support assembly 12 and the hand rest 28 define a cane.

The height of the crutch construction is easily adjusted through the adjusting mechanism which requires only the rotating movement of the pad 18 to loosen the locking wedge 78. The lower tubular member 14 is thus easily adjusted relative to the upper tubular member 16 for obtaining the necessary adjusted vertical position for the crutch.

The intermediate support member 20, the hand rest 28 and the cuff 64 are preferably formed of plastic materials. However these materials are of the type that can easily absorb heavy loads without breaking or cracking, and thus can absorb without difficulty the loads exerted by the weight of the user. In any event the loads are normally exerted in a vertical direction through the vertical lower support member 12, which enables the user to easily manuever the crutch. The use of the plastic materials also enables the hand rest 28 and intermediate support member 20 to be formed in the configuration as illustrated and described and in particular enables the ball and socket universal joint and wide grip hand rest to be easily shaped as required.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A crutch, comprising an elongated lower support assembly, a hand rest interconnected in vertical alignment to said lower support assembly, an upper forearm guide assembly including an upper guide member that is located in offset relation with respect to the vertical axis of said hand rest and lower support assembly, and a forearm cuff member, the vertical axis of which is generally aligned with the vertical axes of said hand rest and lower support assembly, wherein the forces exerted by the weight of the user of said crutch are transmitted directly through the aligned lower support assembly and hand rest for distribution through the hand of the user as located on said hand rest, and through the forearm of the user as positioned in said cuff member, an intermediate support member mounted on said lower support assembly and including a socket that is located in vertical alignment with said lower support member, said hand rest including a ball member that is received in said socket for universal movement therein for locating the hand of the user in substantial vertical alignment with said lower support member when the weight of the user is imposed on said lower support member.

2. A crutch as claimed in claim 1, said upper guide member being defined by an upper tubular element, the axis of which is generally inclined with respect to the vertical and with respect to the axis of said lower support assembly, said cuff member being secured to said upper tubular element in pivotal relation thereon.

3. A crutch as claimed in claim 1, said hand rest having a contoured configuration that includes a horn portion and a widened grip portion that enables the user's weight to be equally distributed around the marginal pads of the user's hand, whereby the forearm of the user as aligned with said hand rest absorbs the load exerted by the user's weight.

4. A crutch as claimed in claim 3, the widened grip portion of said hand rest being generally convext in configuration, and said horn portion being located forwardly of said widened grip portion so as to enable the thumb of the user to extend around one side of said horn portion and the fingers of the user around the opposite side thereof.

5. A crutch as claimed in claim 1, a lock member secured in the socket in said intermediate support member and being operable to lock said ball member in a fixed position in said socket for fixing said hand rest in an adjusted position thereof.

6. A crutch as claimed in claim 5, said lock member including a hollow internal element located in fixed position in said socket, and an external element threadably engaging said internal element and being removably located in engagement with said ball member for locking said ball member and hand rest fixed thereto in an adjusted position.

7. A crutch as claimed in claim 1, said lower support assembly including a lower tubular member and an intermediate tubular member telescopically engaging said lower tubular member, and an adjusting mechanism interfitted in said lower tubular member for adjusting the lower tubular member relative to said intermediate tubular member to adjust the height of the lower support assembly relative to said hand rest and upper support assembly.

8. A crutch as claimed in claim 7, said adjusting mechanism including an adjusting rod located interiorly of said lower tubular member, a lock element engaging said adjusting rod adjacent to the inner end thereof and being movable axially thereon for engagement with the inner end of said lower tubular member, a locking element secured to said rod at the outer end thereof and being operable to rotate said rod for moving said adjusting element relative thereto for urging the inner end of said lower tubular member into engagement with said intermediate member, thereby locking said lower tubular member in an adjusted position thereof.

9. A crutch as claimed in claim 1, said upper guide member being removable relative to said hand rest and lower support assembly, wherein said hand rest and lower support assembly define a cane.

10. A crutch as claimed in claim 9, an intermediate support member joined to said hand rest and to said lower support assembly therebetween and forming part of said cane upon removal of said upper guide member.

11. A hand rest for use in a crutch construction that includes a vertical lower support assembly, comprising a body portion having a configuration that has a generally decreasing taper toward the forward end thereof, the vertical axis of the widest part of said body portion being substantially aligned with said lower support assembly, and a horn portion joined to said body portion at the forward end thereof and projecting upwardly therefrom and being substantially offset with respect to said vertical axis, so that the user's forefinger and thumb are located on opposite sides of the horn portion in use of the crutch construction, wherein the thenar areas of the user's hand are substantially in alignment with said vertical axis and absorb the vertical loads imposed by the weight of the user.

12. A crutch, comprising an elongated lower support assembly, a hand rest interconnected in vertical alignment to said lower support assembly, an upper forearm guide assembly including an upper guide member that is located in offset relation with respect to the vertical axis of said hand rest and lower support assembly, and a forearm cuff member, the vertical axis of which is generally aligned with the vertical axes of said hand rest and lower support assembly, wherein the forces exerted by the weight of the user of said crutch are transmitted directly through the aligned lower support assembly and hand rest for distribution through the hand of the user as located on said hand rest, and through the forearm of the user as positioned in said cuff member, said hand rest having a downwardly projecting portion formed on the underside thereof in which a threaded opening is formed, a ball member having a threaded shank joined thereto that threadably extends into said threaded opening for securing said ball member to said hand rest, and a rounded socket formed in said hand rest and receiving said ball member therein for universal adjustment of said hand rest relative to said lower support assembly.

13. A crutch, comprising an elongated lower support assembly, a hand rest interconnected in vertical alignment to said lower support assembly, an upper forearm guide assembly including an upper guide member that is located in offset relation with respect to the vertical axis of said hand rest and lower support assembly, and a forearm cuff member, the vertical axis of which is generally aligned with the vertical axes of said hand rest and lower support assembly, wherein the forces exerted by the weight of the user of said crutch are transmitted directly through the aligned lower support assembly and hand rest for distribution through the hand of the user as located on said hand rest, and through the forearm of the user as positioned in said cuff member, said lower support assembly including a lower tubular member and an intermediate tubular member telescopically engaging said lower tubular member for adjusting the lower tubular member relative to said intermediate tubular member to adjust the height of the lower support assembly relative to said hand rest and upper support assembly, said adjusting mechanism including an adjusting rod located interiorly of said lower tubular member, a lock element engaging said adjusting rod adjacent to the inner end thereof and being movable axially thereon for engagement with the inner end of said lower tubular member, a locking element secured to said rod at the outer end thereof and being operable to rotate said rod for moving said adjusting element relative thereto for urging the inner end of said lower tubular member into engagement with said intermediate member, thereby locking said lower tubular member in an adjusted position thereof, the uppermost end of said lower tubular element having spaced vertical slots formed therein to define a plurality of spring elements, and said locking element having a tapered configuration, the smallest end thereof being received within the innermost end of said lower tubular element for engagement with said spring elements, wherein rotation of said rod in one direction urges said locking element downwardly into tightfitting engagement with said spring elements for biasing said spring elements against the inner surface of said intermediate tubular element for locking said lower tubular element thereto in adjusted relation.

14. A crutch as claimed in claim 13 a pad joined to the lower most end of said lower tubular element to define the bottom end of said lower support assembly and securely engaging the lowermost end of said rod to define a gripping member for rotating said rod during a vertical adjustment of said lower support assembly.

15. A hand rest for use in a crutch construction that includes a vertical lower support assembly, comprising a body portion having a configuration that has a generally decreasing taper toward the forward end thereof, the vertical axis of the widest part of said body portion being substantially aligned with said lower support assembly and a horn portion joined to said body portion at the forward end thereof and projecting upwardly therefrom, so that the user's forefinger and thumb are located on opposite sides of the horn portion in use of the crutch construction, said horn portion being offset with respect to the vertical axis of the widest part of said body portion and said lower support assembly, the body portion being generally convex in configuration and receiving the hand of the user thereover such that only the pads at the base of the fingers and the heel of the user's hand substantially carry the load exerted by the weight of the user, said body portion and horn portion joined thereto being adjustably movable in a universal motion relative to the lower support assembly.

16. A crutch, comprising an elongated lower support assembly, a hand rest interconnected substantially in vertical alignment to said lower support assembly, an upper guide member located in offset relation with respect to the vertical axis of said hand rest and lower support assembly, said hand rest having a configuration that when grasped by the hand of the user provides for transmittal of vertical forces from the lower support assembly through the metacarpal phalangeal pads and thenar areas of the user's hand and vertically therefrom through the arm of the user.

* * * * *